US006474624B2

(12) United States Patent
Sawano

(10) Patent No.: US 6,474,624 B2
(45) Date of Patent: Nov. 5, 2002

(54) HYDRAULIC JACK

(75) Inventor: Kyozi Sawano, Kani (JP)

(73) Assignee: Kayaba Kogyo Kabushiki Kaisha (JP)

( * ) Notice: Subject to any disclaimer, the term of this patent is extended or adjusted under 35 U.S.C. 154(b) by 0 days.

(21) Appl. No.: 09/735,451

(22) Filed: Dec. 12, 2000

(65) Prior Publication Data

US 2001/0004110 A1 Jun. 21, 2001

(30) Foreign Application Priority Data

Dec. 13, 1999 (JP) ..... 11-352476

(51) Int. Cl.[7] ..... B66F 3/00
(52) U.S. Cl. ..... 254/8 B; 254/124; 254/93 H
(58) Field of Search ..... 254/126, 124, 254/122, 120, 8 R, 8 B, 8 C, 9 R, 9 B, 9 C, 10 R, 10 B, 10 C, 93 H

(56) References Cited

U.S. PATENT DOCUMENTS 5,364,071 A * 11/1994 Lu ..... 254/124

* cited by examiner

*Primary Examiner*—Robert C. Watson
(74) *Attorney, Agent, or Firm*—McGlew and Tuttle, P.C.

(57) ABSTRACT

To facilitate an operation for feeding a jack part into a desired position. A jack part 2, which extends when pressure oil from an oil pressure supply and discharge part 1 is supplied, and contracts when oil is recovered to the oil pressure supply and discharge part 1, is a pantograph type, and a wheel 5 is held in front which is one end in a folded state.

7 Claims, 3 Drawing Sheets

HYDRAULIC JACK

FIELD OF THE INVENTION

This invention relates to a hydraulic jack of the type which is operated manually.

BACKGROUND OF THE INVENTION

Various proposals have been heretofore made in connection with an hydraulic jack set of the manually-operated type. In principle, as shown in FIG. 4, the jack comprises an oil pressure supply and discharge part 1 and a jack part 2. The oil pressure supply and discharge part 1 converts unpressurized oil from a tank 13 into pressure oil by means of an oscillating operation of an operating lever 11 with respect to a pump 12, and supplies the oil to the jack part 2 through a pipe 3. On the other hand, oil from the jack part 2 is returned to the tank 13 by an opening a depressurizing valve 14. It is set so that the jack part 2 extends when pressure oil from the oil pressure supply and discharge part 1 is supplied, and the jack part 2 contracts when pressure oil is discharged.

Accordingly, in the conventional hydraulic jack, for example, the jack part 2 is located at a desired position for extension and contraction thereof to enable movement of heavy articles up and down. Further, where the jack part 2 is a pantograph type, it is possible to set an elevating stroke higher than when the jack part 2 is a cylinder type.

However, when the jack part 2 is a pantograph type, the elevating stroke is large, and therefore, it is necessary to stabilize the jack when the jack is placed on the installing surface such as the surface of the earth. For example, though not shown, a base plate or the like constituting the lower end of the jack part 2 is formed as large as possible.

On the other hand, when the hydraulic jack of this kind is located at a deep position, in most case, the operating lever 11 included in the oil pressure supply and discharge part 1 is used as a pressing/positioning member by which the jack part 2 is slidably moved and fed into the desired position.

In this case, the larger the base plate or the like constituting the lower end of the jack part 2, which enhances the stability when installed, as described above, here poses an inconvenience in that the feeding operation is difficult.

SUMMARY AND OBJECTS OF THE INVENTION

This invention has been designed in view of the aforementioned circumstances. An object of the invention is to provide a hydraulic jack in which feeding/positioning a jack part into a desired position is optimized for a wide use of the jack in different applications.

For achieving the aforesaid object, a means of the present invention comprises an oil pressure supply and discharge part, and a jack part connected to the oil pressure supply and discharge part through a flow passage. The jack part is provided with a hydraulic cylinder, a pantograph type link connected to the hydraulic cylinder through a driving link, and a wheel provided at a suitable position of the pantograph type link.

In this case, preferably, the pantograph type link comprises a pair of rotatable lower links, a pair of upper links pivotally mounted on extreme ends of the lower links, respectively, through shafts, and pressure receiving plates provided on the upper ends of the upper links, respectively, the driving link is connected rotatably between the hydraulic cylinder and the lower links, and the wheel is mounted on one of the shafts.

In this case, preferably, the lower links and the upper links are provided in a paired relation before and behind the hydraulic cylinder, and the wheel is mounted on the front shaft for pivotally mounting the front lower link and the front upper link.

Further, in the above-described means, preferably, a guide tube comprising an outer tube, and an inner tube slidably inserted into the outer tube, is connected to the jack part. The oil pressure supply and discharge part is provided with a holder member, the pipe is inserted into the guide tube, and the guide tube is connected to the holder member reparably and rotatably.

In this case, preferably, an operating rod extending in a direction opposite to the guide tube is connected to the holder member.

Further, preferably, the jack part has a base plate movably placed on the installing surface, and the base plate is connected to the inner tube through a connecting construction.

Furthermore, preferably, the oil pressure supply and discharge part has a pump and a tank. The tank comprising a bellows type bladder for setting a volume chamber therein, and a protective casing formed of a visible material for receiving the bladder therein.

DETAILED DESCRIPTION OF THE PREFERRED EMBODIMENTS

Figure 1:
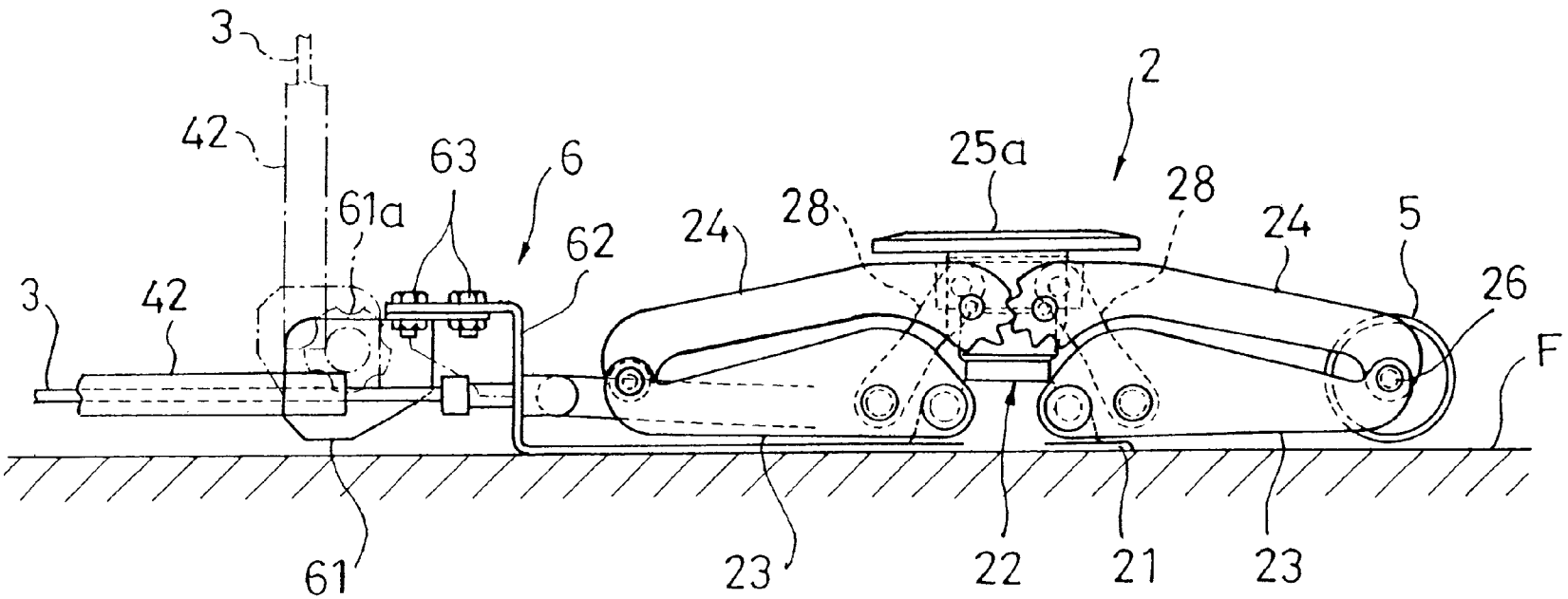
FIG. 1 is a front view showing a state where a jack part of a hydraulic jack according to one embodiment of this invention is folded.
Figure 2:
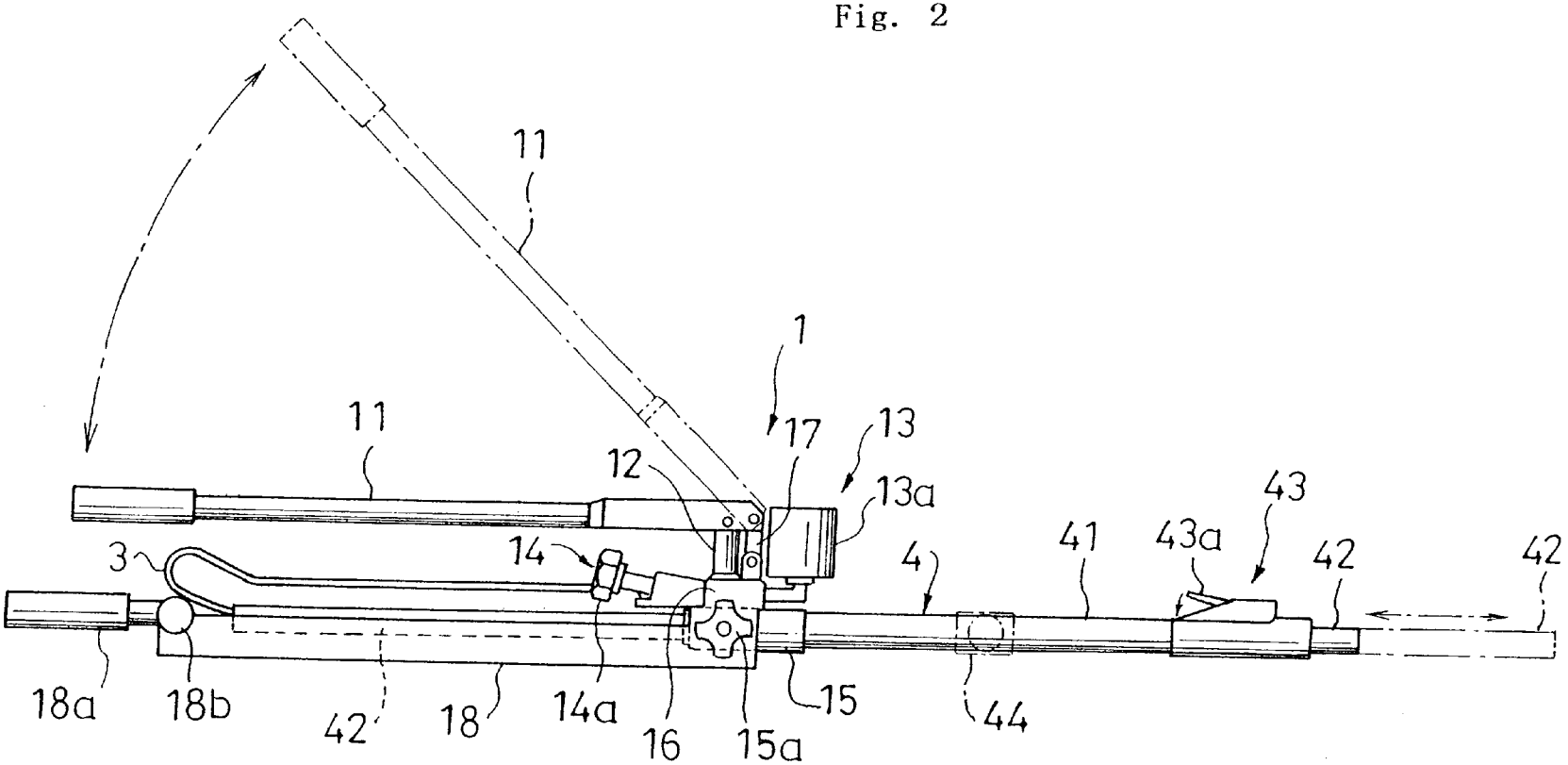
FIG. 2 is a front view in a reduced scale showing an oil pressure supply and discharge part connected to the jack part in FIG. 1 along with a pipe and a guide tube.

This invention will now be described on the basis of the embodiments shown in the drawings. A jack part 2 in the hydraulic jack according to this invention as shown in FIG. 1, is in communication with an oil pressure supply and discharge part 1 constituted as shown in FIG. 2, for example, through a pipe 3 which is a flow passage.

First, the oil pressure supply and discharge part 1 will be described. This oil pressure supply and discharge part 1 comprises an operating lever 11, a pump 12, a tank 13, and a depressurizing valve 14. Oil from the tank 13 is supplied as pressure oil to the jack part 2 (see FIGS. 1, 2) through the pipe 3 by operation of the pump 12 caused by an oscillating operation of the operating lever 11. Return oil which is oil from the jack part 2 is likewise flown into the tank 13 through the pipe 3 by opening a depressurizing valve 14 by manual operation.

At this time, in the oil pressure supply and discharge part 1, the pump 12, the tank 13, and the depressurizing valve 14 are arranged at a mount part 16 provided integrally on an upper end of a holder member 15. The holder member 15 is inserted rotatably into a guide tube 4.

The operating lever 11 is pivotally mounted on the mount part 16 through a link 17 and is connected to the pump 12.

The lever 11 is oscillated up and down, as shown by an imaginary arrow and in an imaginary lined diagram in FIG. 2, to operate the pump 12.

It is noted of course that the operating lever 11 is not formed to be integral, as shown, but may be capable of being extended and contracted, though not shown.

The pump 12 is set so that when in operation, oil from the tank 13 may be supplied as pressure oil to the jack part 2 through the pipe 3. The pump 12 used in the present invention has a well-known construction.

In principle, the tank 13 has a volume chamber (not shown) making volume variable while being separated from gas, and is set so that a fixed quantity of oil may be received in the volume chamber.

In one embodiment, the tank 13 comprises a bladder (not shown) which presents a bellows appearance and is arranged in the interior of the volume chamber. Since the bladder in the volume chamber separates oil from gas, even if the tank 13 should be arranged sideways or turned upside down, there is avoided the inconvenience that gas within the volume chamber flows into the pump 12 and makes it impossible to operate the pump, or that the gas flows into the jack part 2 to make it impossible to provide jack pressure.

Further, the protective casing 13*a* is formed of a visible material. If, for example, the jack part 2 is so deeply positioned that the extension and contraction state cannot be visualized, it is possible to determine the extension and contraction state of the jack part 2 by visualizing a so-called swelling of the bladder.

The depressurizing valve 14 is designed as a check valve construction for checking a flow of oil from the jack part 2. The check valve state is released by a rotational operation with respect to an operating part 14*a* formed from a dial or the like to return oil from the jack part 2 to the tank 13.

The holder member 15 is inserted reparably into a guide tube 4 described later and is held integrally on an extreme end of an operating rod 18 extended at a rear of the guide tube 4 and in the axial direction.

That is, in the embodiment shown, when the jack part 2 is located at a desired position by the guide tube 4, the operating lever 11 is not used but instead the operating rod 18 is used or pressed to position the jack part 2.

By the setting as described above, when the jack part 2 is located at a desired position, a so-called exclusive-use pressing/positioning member is provided, and the operating lever 11 need not to be used as a pressing/positioning member. Accordingly, as compared with the case where the operating lever 11 is used as a pressing member, the operability of the present invention is enhanced, and positioning of the jack part 2 can be executed positively.

Besides, since the operating lever 11 is not used as the pressing/positioning member, as compared with the case where the operating lever 11 is as the pressing member, the operating lever 11 can be set to a so-called insignificant constitution as long as the fixed pump operation is enabled.

Therefore, when the operating rod 18 is to be an exclusive-use pressing member, it is preferred that handles 18*a* and 18*b* are provided at the rear end thereof, as shown in FIG. 1.

As shown, the operating rod 18 is formed to have a section in the shape of a shallow U, and has an axial fixed strength. The rear end of the guide tube 4 described later is present at the inside of the lever so as to protect the rear end of the guide tube 4.

In the oil pressure supply and discharge part 1 formed as described above, the supply and discharge of pressure oil with respect to the jack part 2 can be executed by the operation of the pump 12 through the operating lever 11 and the opening of the depressurizing valve 14. In addition, the jack part 2 can be arranged at a fixed position positively by the operating rod 18.

Besides, the pump 12, the tank 13, and the holder member 15 for holding the depressurizing valve 14, constitute the main part of the oil pressure supply and discharge part 1, and are connected reparably to the guide tube 4 whereby the oil pressure supply and discharge part 1 may be rotated relative to the guide tube 4. Accordingly, it is possible to maintain the guide tube 4, that is, the jack part 2 in a suitable rotating state or position without being limited to the rotating state/position of the oil pressure supply and discharge part 1.

Further, the holder member 15 is separated from the guide tube 4, and the pipe 3 described later is folded, whereby the full length of the hydraulic jack can be shortened. Accordingly, the hydraulic jack can be compacted.

The oil pressure supply and discharge part 1 is integrated in the form of a rod with the jack part 2 through the guide tube 4. Therefore, where the oscillating operation of the operating lever 11 cannot be executed, the pipe 3 portion is folded to release the rod-like state so as to enable the oscillating operation of the operating lever 11.

While in the illustration, means for securing the holder member 15 to the guide tube 4 comprises a fastening bolt 15*a* engaged with the holder member 15, it is to be noted that instead of the former, for example, a fastening means comprising a chuck construction or the like may be employed, though not shown.

The pipe 3 for communicating the oil pressure supply and discharge part 1 with the jack part 2, that is, for forming an oil passage therebetween, is a type generally utilized for hydraulic apparatus of this kind, and has a fixed pressure-resistant ability and is set to be very flexible.

It is to be noted of course that the length of the pipe 3 is set to a length so as to allow maximum extension of the guide tube 4 as described later.

The guide tube 4, with the pipe 3 inserted therein, is reparably connect the guide holder 15 and can be extended and contracted with an inner tube 42 slidably inserted into an outer tube 41.

The oil pressure supply and discharge part 1 is connected reparably to the rear end of the outer tube 41 which is the left end in FIG. 2, and the jack part 2 described later is connected to the extreme end of the inner tube 42 which is the right end in FIG. 1 (see FIG. 1).

Incidentally, the connection of the jack part 2 to the extreme end of the inner tube 42 is achieved by a connecting construction 6 described later. In this case, it is set so that as shown in the imaginary line of FIG. 1, the inner tube 42, that is, the guide tube 4 may be oscillated relative to the jack part 2.

Since it is set so that the guide tube 4 may be oscillated relative to the jack part 2, as described above, it is advantageous in that the jack part 2 can be located in a desired suitable extension and contraction direction irrespective of the extending direction of the guide tube 4.

On the other hand, the extension and contraction state of the guide tube 4 is maintained by a stopper 43 provided in the outer periphery at the extreme end of the outer tube 41. The stopper 43 has a pin which is connected to the extreme end of a lever 43*a* pivotally mounted on a holder part held fixed on the outer periphery at the extreme end of the outer tube 41, though not shown in detail.

The lever 43*a* is designed so that the extreme end of the pin is pressed down by an urging force of an urging member not shown. It is set, though not shown, that the pin may, when moved down, pass though a hole bored integrally in the holder part and the outer tube 41, and also a hole bored in the inner tube 42 aligned with the aforesaid hole.

It is noted of course that with respect to the holes in the inner tube 42, a plurality of holes are bored at suitable intervals in an axial direction of the inner tube 42.

Therefore, the stopper 43 releases, at least when the rear end of the lever 43*a* is pressed down to pull the pin out of the holes in the inner tube 42, the connected state between the outer tube 41 and the inner tube 42, to enable the relative movement therebetween, that is, the moving in/out of the inner tube 42 relative to the outer tube 41.

Incidentally, the guide tube 4 has a handle 44 like the handle 18*b* at the rear end of the operating rod 18 to enable rotation thereof about the axis of the guide tube 4 at the time of rising and falling operation along with the handle 18*b*. However, it is of course possible that the handle 44 may be omitted.

In another embodiment of this invention, the jack part 2 holds a wheel 5 at an extreme end which is one end (right end in FIG. 1) in the folded state shown in FIG. 1.

Describing further, this jack part 2 has a base plate 21 placed on the installing surface F, and a hydraulic cylinder 22 which extends up and down is provided on the upper surface of the base plate 21, and has is connected to an extension linkage.

In this invention, the base plate 21 is formed as large as possible, and is set, in the illustration, to be large in an axial direction of the hydraulic jack which is a lateral direction in FIGS. 1 and 3, in terms of the connecting construction 6 described later.

In the hydraulic cylinder 22, a ram 22*b* can be moved in and out of a cylinder part 22*a* formed integral with the upper surface of the base plate 21, and a pressure chamber R defined between the lower end of the ram 22*b* and the inner bottom of the cylinder part 22*a* is communicated with the oil pressure supply and discharge part 1 through the pipe 3.

Therefore, the hydraulic cylinder 22 extends when pressure oil from the oil pressure supply and discharge part 1 is supplied to the pressure chamber R, and contracts when oil in the pressure chamber R is returned to the oil pressure supply and discharge part 1.

The extension linkage has a pair of front and rear lower link members 23 whose lower ends are pivotally mounted to the base plate 21, a pair of front and rear upper link members 24 whose lower ends are pivotally mounted to extreme ends of the lower link members 23, and a bracket 25 pivotally mounted to the upper end of the upper link member 24. The upper end of the bracket 25 is connected a pressure receiving plate 25*a* in which the upper end surface thereof is the main pressure receiving surface of the jack part 2.

Incidentally, the bracket 25 is set so as to be across and on the hydraulic cylinder 22 when the jack part 2 is folded/contracted, that is, when the extension linkage is in a folded state.

Figure 3:
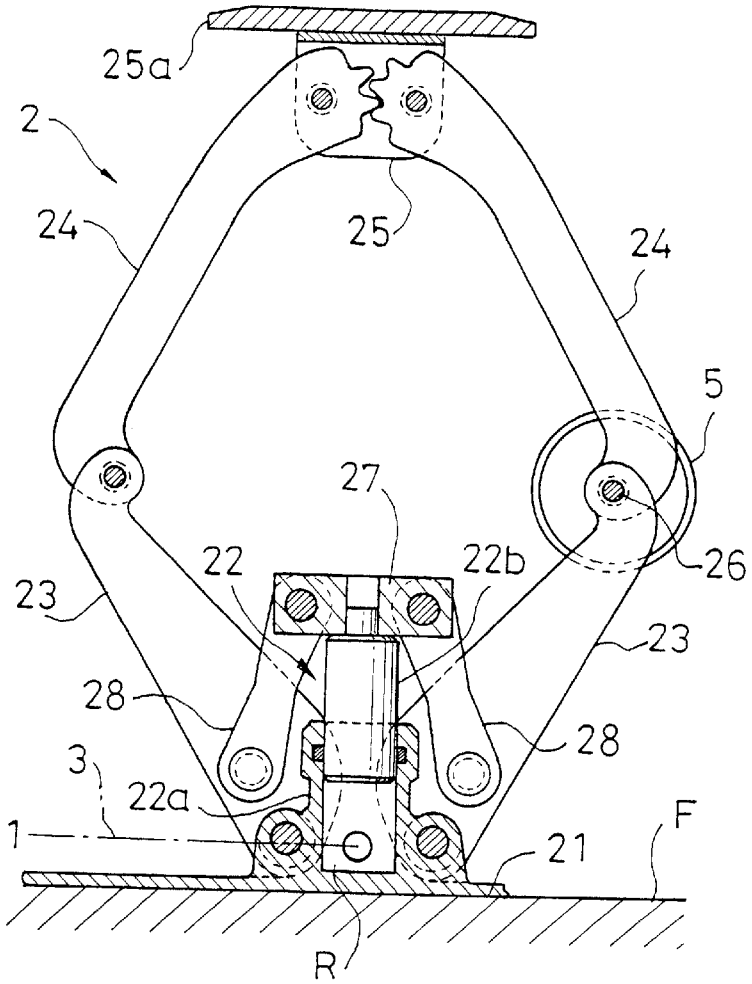
FIG. 3 is an enlarged front view showing a state where the jack part in FIG. 1 is extended.
Figure 4:
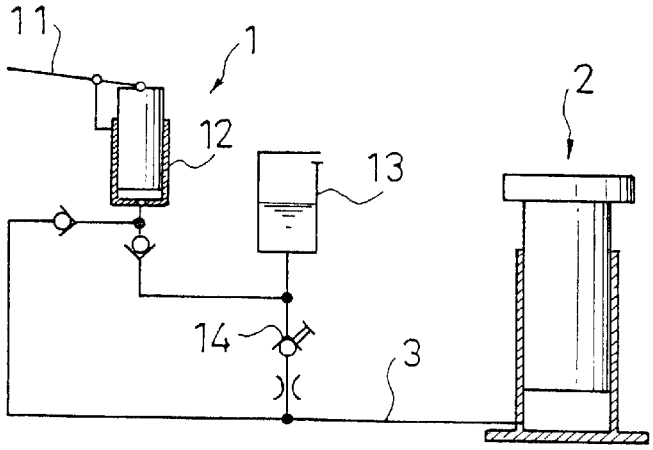
FIG. 4 is a circuitry view showing a conventional hydraulic jack in terms of principle.

The extension link is pivotally mounted to the upper end of the lower link member 23 in front which is right-hand in FIGS. 1 and 3, and a wheel 5 is provided on a shaft 26 for pivotally mounting the lower end of the upper link member 24 likewise in front.

In this case, the wheel 5 may contact the installing surface F such as the surface of the earth in the state of being held at the extreme end which is one end (right end in FIGS. 1 and 3) in the state that the extension link is folded, and may be adjacent to the installing surface F at a position slightly elevated from the installing surface F.

When the wheel 5 is at a position slightly elevated, the other end of the jack part 2 in the folded state, that is, the rear end which is left end in FIGS. 1 and 3 is raised to thereby enable the contact of the wheel 5 with the installing surface F.

Further, where the wheel 5 is initially in contact with the installing surface F, the rear end of the jack part 2 in the folded state is moved up a little to enable the release of the base plate 21 in the jack part 2 from contact with the installing surface F.

Furthermore, since the wheel 5 is mounted on the shaft 26 for pivotally mounting the extreme end of the lower link member 23 and the lower end of the upper link member 24, it is not necessary to separately provide a shaft for pivotally mounting the wheel 5.

On the other hand, in the hydraulic cylinder 22, the bracket 27 is connected to the upper end of the ram 22*b*, and the upper ends of a pair of driving link members 28 are pivotally mounted to the bracket 27.

The lower ends of the pair of driving link members 28 are pivotally mounted in the area of the lower ends of the pair of lower link members 23 of the extension linkage.

Therefore, in the jack part 2, the extension linkage is raised and lowered by the extension and contraction of the hydraulic cylinder 22 through the driving link members 28, and the pressure receiving plate 25*a* on the upper end of the extension linkage moves up and down.

In the jack part 2, the rear end thereof is raised when folded/compacted whereby the lower end of the outer periphery of the wheel 5 may be placed in contact with the installing surface F. At that time, the jack part 2 can be moved to a suitable position by the rolling of the wheel 5.

Incidentally, in the illustration, the jack part 2 is connected to the guide tube 4, that is, the extreme end of the inner tube 42 by the connecting construction 6, as described previously.

The connecting construction 6 has a bracket 61 connected to the extreme end of the inner tube 42, a bracket 62 integral with the base plate 21 of the jack part 2, and a bolt and nut 63 for connecting both the brackets 61 and 62.

In the illustration, the bracket 61 has a fastening bolt 61*a*, and the oscillation of the bracket 61 relative to the bracket 62 can be executed by the rotating the fastening bolt 61*a*.

The bracket 62 is made integral with the base plate 21 of the jack part 2 to lengthen the overall length thereof Accordingly, the jack part 2 is hard to fall in the longitudinal direction which is the axial direction to increase the so-called stability.

At that time, the base plate 21 is to be extended backward of the jack part 2, which comprises no obstruction encountered when the jack part 2 is moved ahead to place the wheel 5 in contact with the installing surface F.

It is to be noted of course that in connecting the extreme end of the inner tube 42 to the bracket 61, so-called securing may be employed instead of the means shown in the figure. In this case, alternatively, a material rich in elasticity, for example, such as rubber, may be interposed between the bracket 61 and the extreme end of the inner tube 42 to provide a so called play therebetween.

The hydraulic jack formed as described above can be utilized such that the jack part 2 is moved to a desired position, and the jack part 2 is extended and contracted by operation of the oil pressure supply and discharge part 1.

Where a position for locating the jack part 2 is, for example, a deep position, the inner tube 42 is pulled out of the outer tube 41 to lengthen the guide tube 4, whereas the operating rod 18 is pushed to locate the jack part 2 to the desired deep position.

When locating the jack part 2 to a desired position, the jack part 2 may need be moved sideways. The guide tube 4 is then rotated, that is, rotated about the axis thereof by operation of to the handle 18*b* in the operating rod 18 or the handle 44 in the guide tube 4.

Further, where the oil pressure supply and discharge part 1 needs be moved in the rotating direction with respect to the jack part 2, including the case where the jack part 2 is moved sideways, that is where the extension and contraction direction of the jack part 2 needs be deviated with respect to the oscillating direction of the operating lever 11 in the oil pressure supply and discharge part 1, the holder member 15 is rotated in the outer periphery of the guide tube 4.

When the holder member 15 is separated from the guide tube 4 and the pipe 3 is bent, and the oil pressure supply and discharge part 1 is integral with the jack part 2 in a rod-like fashion through the guide tube 4 to fail to execute the oscillating operation of the operating lever 11, the oil pressure supply and discharge part 1 can be operated such as that the operating lever 11 is subjected to the oscillating operation irrespective of the so-called direction of the jack part 2.

After the use, the jack part 2 is contracted, by the operation of the depressurizing valve 14 in the oil pressure supply and discharge part 1, to draw the jack part 2 downward of the heavy article or the like, thus retreating and removing the whole device for reuse.

At that time, the holder member 15 is separated from the guide tube 4, and the pipe 3 is bent, whereby the overall length is shortened, and thus the hydraulic jack can be compacted.

While in the foregoing, the pipe 3 for communicating the oil pressure supply and discharge part 1 with the jack part 2 is inserted into the guide tube 4 formed to be extended and contracted, it is noted of course that instead, though not shown, the guide tube 4 may be omitted, and accordingly, connection may be made merely by the highly flexibility pipe 3, and no integrity between them, that is, freedom in direction therebetween may be provided.

Further, the oil pressure supply and discharge part 1 and the jack part 2 may be joined directly, and connected through the flow passage.

As described above, according to the invention, since the guide tube inserted into a part of the pipe for communicating the oil pressure supply and discharge part with the jack part is set to be extended and contracted by slidably inserting the inner tube into the outer tube, the jack part can be easily located, for example, to a deep position separate from the position of the oil pressure supply and discharge part.

Further, according to the invention, since the oil pressure supply and discharge part is separably connected to the guide tube, the oil pressure supply and discharge part can be rotated relative to the guide tube. Accordingly, the guide tube, that is, the jack part can be maintained in a suitable rotating/angular state without being restricted by the rotating/angular state of the oil pressure supply and discharge part.

Where the oil pressure supply and discharge part is separated from the guide tube, and the pipe for communicating the oil pressure supply and discharge part with the jack part is bent, the overall length of the hydraulic jack can be shortened, and accordingly, the hydraulic jack can be compacted.

At this time, there can be provided the state that the oil pressure supply and discharge part is integral with the jack part in a so-called rod-like fashion through the guide tube. Accordingly, the operation of the oil pressure supply and discharge part can be executed such that the operating lever is oscillated in the oil pressure supply and discharge part irrespective of so-called direction of the jack part.

When the tank constituting the oil pressure supply and discharge part has the volume chamber for making the volume variable while being separated from gas, even if the position should occur in which the tank is positioned sideways or turned upside down, there can be avoided in advance the inconvenience that the gas within the volume chamber flows into the pump causing pump operation to fail, or flows into the jack part and fail to provide a fixed jack pressure.

Further, where the bladder constituting the volume chamber is received in the protective casing formed of a visible material, for example, even where the jack part is located at a so deep position that an operator cannot visualize the extension and contraction state, the so-called swelling state of the bladder is visualized to enable determining the extension and contraction state of the jack part.

Further, according to the invention, since the wheel of which outer peripheral lower end is made adjacent to the installing surface such as the surface of the earth is held at the extreme end which is one end in the state that the jack part is folded, the rear end which the other end of the jack part can be raised to bring the outer peripheral lower end of the wheel into contact with the installing surface, thus facilitating the feeding operation of the jack part into the desired position.

Further, since the wheel is provided on the shaft for pivotally mounting the upper end of the lower link member to the lower end of the upper link member, the shaft for pivotally mounting the wheel need not be provided separately. Accordingly, the jack part formed into a pantograph type heretofore proposed can be utilized without requiring a considerable change in design.

As a result, according to this invention, the feeding operation with respect to the desired position of the jack part is facilitated, without requiring an operator to pass under a heavy article such as a vehicle. While insuring safety of operation, for example, the jack part can be located to a deep position. The present invention provides the advantage of being optimum for a wide-use of applications.

What is claimed is:

1. A hydraulic jack comprising: an oil pressure supply and discharge part; and a jack part connected to the oil pressure supply and discharge part through a flow passage, said jack part being provided with a hydraulic cylinder, a pantograph type link connected to the hydraulic cylinder through a driving link, and a wheel provided on the pantograph type link, said pantograph type link comprising a pair of rotatable lower links, a pair of upper links pivotally mounted on extreme ends of the lower links through shafts, and a pressure receiving plate provided on upper ends of said upper links, said driving link being rotatably connected between the hydraulic cylinder and the lower links, wherein the lower links and the upper links are provided in a paired relation as front links and rear links before and behind said hydraulic cylinder respectively, and the wheel is rotatably mounted on said shaft of said front links.

2. The hydraulic jack according to claim 1, wherein a guide tube comprising an outer tube and an inner tube slidably inserted into the outer tube is connected to the jack part, the oil pressure supply and discharge part is provided with a holder member;

said flow passage includes a pipe is inserted into the guide tube, and the guide tube is connected to the holder member separably and rotatably.

3. The hydraulic jack according to claim 2, wherein an operating rod extending in a direction opposite to the guide tube is connected to the holder member.

4. The hydraulic jack according to claim 2, wherein the jack part has a base plate movably placed on an installing surface, and the base plate is connected to the inner tube through a connecting construction.

5. The hydraulic jack according to claim 1, wherein the oil pressure supply and discharge part has a pump and a tank, said tank comprising a bellows type bladder for setting a volume chamber therein, and a protective casing formed of a visible material for receiving the bladder therein.

6. A hydraulic jack comprising:

a pressure supply/discharge part;

a flow passage connected to said supply/discharge part;

a jack part in communication with said supply/discharge part through said flow passage, said jack part including a hydraulic cylinder with a hydraulic piston connected to a driving link, and a pantograph linkage connected to said hydraulic piston through said driving link, said pantograph linkage including first links with first and second ends, said first ends being pivotally connected to said hydraulic cylinder, said second ends including a shaft, said pantograph linkage having second links with first and second ends, said first ends of said second links being pivotally connected to said shafts of said second ends of said first links, said jack part includes a pressure receiving plate connected to said second ends of said second links;

a wheel pivotally mounted on one of said shafts connecting said first and second links.

7. A hydraulic jack comprising:

a jack part including a hydraulic cylinder with a hydraulic piston connected to a driving link, and a pantograph linkage connected to said hydraulic piston through said driving link;

a wheel rotatably connected to said pantograph linkage;

a flow passage connected to said jack part;

a pressure supply/discharge part in communication with said jack part through said flow passage, said oil pressure supply and discharge part including a pump and a tank, said tank including a bellows type bladder for setting a volume chamber in said tank, said tank also including a protective casing formed of a visible material for receiving said bladder.

* * * * *